US009547269B1

(12) United States Patent
Tsunoda et al.

(10) Patent No.: US 9,547,269 B1
(45) Date of Patent: Jan. 17, 2017

(54) IMAGE FORMING APPARATUS AND IMAGE FORMING METHOD

(71) Applicant: FUJI XEROX CO., LTD., Tokyo (JP)

(72) Inventors: Shinichi Tsunoda, Kanagawa (JP); Eiji Morita, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/056,240

(22) Filed: Feb. 29, 2016

(30) Foreign Application Priority Data

Sep. 7, 2015 (JP) ..... 2015-176163

(51) Int. Cl.
*G03G 15/00* (2006.01)

(52) U.S. Cl.
CPC ..... *G03G 15/5058* (2013.01); *G03G 15/5041* (2013.01)

(58) Field of Classification Search
CPC ..... G03G 15/5058; G03G 15/5041; G03G 2215/00059; G03G 2215/0164
See application file for complete search history.

(56) References Cited

U.S. PATENT DOCUMENTS

2014/0153941 A1* 6/2014 Miyazaki ..... G03G 15/0189 399/49
2015/0110515 A1* 4/2015 Yamasaki ..... G03G 15/5016 399/81

FOREIGN PATENT DOCUMENTS

JP H07-221986 A 8/1995

* cited by examiner

*Primary Examiner* — Sandra Brase
(74) *Attorney, Agent, or Firm* — Oliff PLC

(57) ABSTRACT

An image forming apparatus includes a toner image forming section, a detection section, a variation calculation section, a user setting acquisition section, an adjustment ratio calculation section, and an adjustment section. The toner image forming section forms a toner image. The detection section detects a toner density of the formed toner image. The variation calculation section obtains a variation in toner density based on the detected toner density. The user setting acquisition section acquires a user setting concerning a degree of adjusting the toner density. The user setting is set by a user. The adjustment ratio calculation section calculates an adjustment ratio which is a ratio at which the user setting is reflected, in accordance with the variation in toner density. The adjustment section adjusts the toner density based on the variation in toner density, the user setting, and the adjustment ratio.

7 Claims, 14 Drawing Sheets

FIG. 8

| Cin [%] | 5 | 15 | 30 | 50 | 75 | 95 | 100 |
|---|---|---|---|---|---|---|---|
| LOW DENSITY PORTION [%] | 25 × a | 75 × a | 50 × a | 25 × a | | | |
| MIDDLE DENSITY PORTION [%] | | 10 × a | 25 × a | 50 × a | 25 × a | 10 × a | |
| HIGH DENSITY PORTION [%] | | | | | 10 × a | 25 × a | 10 × a |

FIG. 12

| Cin [%] | 5 | 15 | 30 | 50 | 75 | 95 | 100 |
|---|---|---|---|---|---|---|---|
| LOW DENSITY PORTION [%] | 25×a | 75×a | 50×a | 25×a | | | |
| MIDDLE DENSITY PORTION [%] | | 10×a | 25×a | 50×a | 25×a | 10×a | |
| HIGH DENSITY PORTION [%] | | | | | 10×b | 25×b | 10×b |

IMAGE FORMING APPARATUS AND IMAGE FORMING METHOD

CROSS-REFERENCE TO RELATED APPLICATIONS

This application is based on and claims priority under 35 USC 119 from Japanese Patent Application No. 2015-176163 filed Sep. 7, 2015.

BACKGROUND (i) Technical Field

The present invention relates to an image forming apparatus and an image forming method.

(ii) Related Art

In an image forming apparatus such as a copier and a printer, which uses an electrophotographic process, for example, a photoreceptor which is formed to have a drum shape is uniformly charged. The charged photoreceptor is exposed with light which is controlled based on image information, and thus, an electrostatic latent image is formed on the photoreceptor. A developing device develops the formed electrostatic latent image with a toner into a visible image (toner image). The toner image is transferred to a recording material and the transferred toner image is fixed by the fixing device, and thus, an image is formed.

SUMMARY

According to an aspect of the invention, an image forming apparatus includes a toner image forming section, a detection section, a variation calculation section, a user setting acquisition section, an adjustment ratio calculation section, and an adjustment section. The toner image forming section forms a toner image. The detection section detects a toner density of the formed toner image. The variation calculation section obtains a variation in toner density based on the detected toner density. The user setting acquisition section acquires a user setting concerning a degree of adjusting the toner density. The user setting is set by a user. The adjustment ratio calculation section calculates an adjustment ratio which is a ratio at which the user setting is reflected, in accordance with the variation in toner density. The adjustment section adjusts the toner density based on the variation in toner density, the user setting, and the adjustment ratio.

BRIEF DESCRIPTION OF THE DRAWINGS

Exemplary embodiments of the present invention will be described in detail based on the following figures, wherein:

FIG. 8 is a diagram illustrating an example in which a user setting is applied in the first exemplary embodiment;

FIG. 12 is a diagram illustrating an example in which a user setting is applied in the second exemplary embodiment;

DETAILED DESCRIPTION

Hereinafter, an exemplary embodiment of the invention will be described in detail with reference to the accompanying drawings.

Descriptions of Overall Configuration of Image Forming Apparatus

Figure 1:
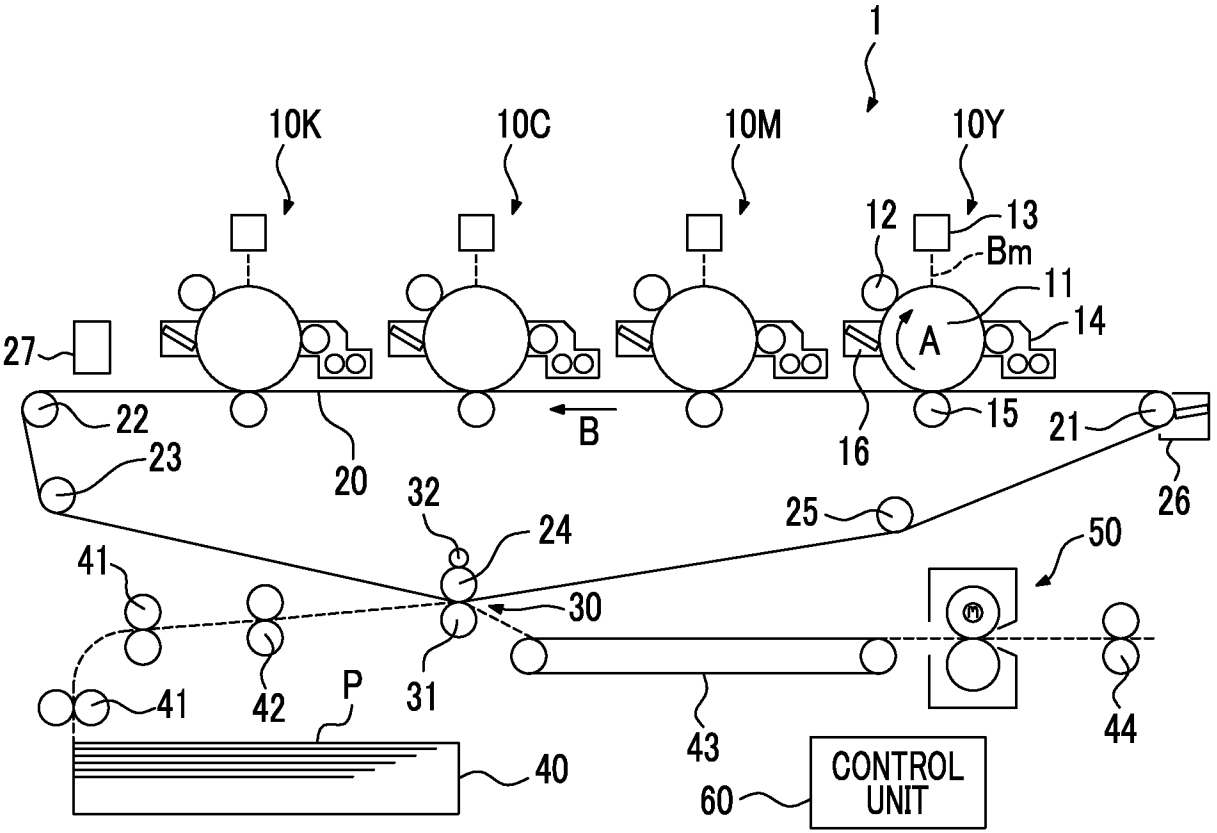
FIG. 1 is a diagram illustrating an outline of an image forming apparatus according to an exemplary embodiment.

FIG. 1 is a diagram illustrating an outline of an image forming apparatus 1 according to the exemplary embodiment.

The image forming apparatus 1 includes plural (4 in the exemplary embodiment) image forming units 10 (specifically, 10Y (yellow), 10M (magenta), 10C (cyan), and 10K (black)) which are an example of a toner image forming section, for example. The toner image forming section forms a toner image of each color component by using an electrophotographic process. The image forming apparatus 1 includes an intermediate transfer belt 20 that sequentially transfers (primarily transfers) color component toner images formed by the image forming units and holds the transferred images. The image forming apparatus 1 further includes a second transfer device 30 that collectively transfers (secondarily transfers) the toner images which have been transferred onto the intermediate transfer belt 20, onto paper (recording material) P. The image forming apparatus 1 further includes a fixing device 50 and a control unit 60. The fixing device 50 fixes the toner image which has been secondarily transferred, onto the paper P. The control unit 60 is an example of a control section that controls mechanism units of the image forming apparatus 1.

The image forming units 10 (10Y, 10M, 10C, and 10K) have the same configuration except for the color of the toner to be used. Thus, descriptions will be made by using the yellow image forming unit 10Y as an example. The yellow image forming unit 10Y includes a photosensitive drum 11.

The photosensitive drum 11 includes a photoreceptive layer (not illustrated). The photosensitive drum 11 is arranged so as to be rotatable in a direction indicated by an arrow A, and holds an image. A charging roll 12, an exposure unit 13, a developing device 14, a primary transfer roll 15, and a drum cleaner 16 are arranged around the photosensitive drum 11.

Among these components, the charging roll 12 is a rotation member that charges a surface of the photosensitive drum 11 and is disposed so as to contact with the photosensitive drum 11. The charging roll 12 is connected to a charging power source (not illustrated). The charging power source supplies a negative DC charging bias obtained by superimposing an AC charging bias of a predetermined frequency, to the charging roll 12.

The exposure unit 13 exposes the surface of the photosensitive drum 11, which is charged by the charging roll 12, so as to form an electrostatic latent image. The exposure unit 13 writes an electrostatic latent image on the photosensitive drum 11 charged by the charging roll 12, by using a laser beam Bm. The developing device 14 collects a toner of the corresponding color component (yellow toner in the yellow image forming unit 10Y), and develops an electrostatic latent image on the photosensitive drum 11 by using the collected toner. The primary transfer roll 15 primarily transfers a toner image formed on the photosensitive drum 11 to the intermediate transfer belt 20. The drum cleaner 16 removes residual substances (toner and the like) on the photosensitive drum 11 after primary transfer. A developing bias supply (not illustrated) for applying a predetermined developing bias to the developing device 14 is connected to the developing device 14. A transfer bias supply (not illustrated) for applying a predetermined transfer bias to the primary transfer roll 15 is connected to the primary transfer roll 15.

The intermediate transfer belt 20 is stretched and supported by plural (5 in the exemplary embodiment) support rolls, so as to be rotatable. Among these support rolls, a driving roll 21 stretches the intermediate transfer belt 20 and drives the intermediate transfer belt 20 so as to be rotated in a direction indicated by an arrow B. A tension roll 22 and a tension roll 25 stretch the intermediate transfer belt 20 and are rotated by the intermediate transfer belt 20 which is driven by the driving roll 21. A correction roll 23 stretches the intermediate transfer belt 20 and functions as a steering roll which regulates belt walk in a direction perpendicular to the transporting direction of the intermediate transfer belt 20. The steering roll is arranged so as to be tiltable by using one end portion of the steering roll in an axis direction, as a fulcrum. A backup roll 24 stretches the intermediate transfer belt 20 and functions as a constituent member of the second transfer device 30 which will be described later.

A belt cleaner 26 is arranged at a part which faces the driving roll 21 with the intermediate transfer belt 20 interposed between the belt cleaner 26 and the driving roll 21. The belt cleaner 26 removes residual substances (toner and the like) on the intermediate transfer belt 20 after secondary transfer. A density detection sensor 27 which is an example of a detection section is disposed over the intermediate transfer belt 20 so as to face the intermediate transfer belt 20. The density detection sensor 27 is disposed so as to be adjacent to the image forming unit 10K for black, reads a toner image of the corresponding color which has been primarily transferred onto the intermediate transfer belt 20 and detects toner density of this toner image.

The second transfer device 30 includes a secondary transfer roll 31 and the backup roll 24. The secondary transfer roll 31 is disposed on a toner image holding surface side of the intermediate transfer belt 20 so as to be press-contacted. The backup roll 24 is disposed on a back surface side of the intermediate transfer belt 20 and functions as a counter electrode of the secondary transfer roll 31. A feeding roll 32 is disposed so as to contact with the backup roll 24. The feeding roll 32 applies a secondary transfer bias of the same polarity as a charging polarity of the toner, to the backup roll 24. The secondary transfer roll 31 is grounded.

A paper transporting system includes a paper tray 40, a transport roll 41, a registration roll 42, a transport belt 43, and an exit roll 44. In the paper transporting system, paper P loaded in the paper tray 40 is transported by the transport roll 41, and then temporarily stopped at the registration roll 42. Then, the temporarily stopped paper is sent to a secondary transfer position of the second transfer device 30 at a predetermined timing. The paper P after secondary transfer is transported to the fixing device 50 using the transport belt 43. The paper P exiting from the fixing device 50 is sent to the outside of the apparatus by the exit roll 44.

Next, a basic image forming process of the image forming apparatus 1 will be described. If a start switch (not illustrated) is operated to be ON, a predetermined image forming process is performed. Specifically described, for example, in a case where the image forming apparatus 1 is configured as a printer, digital image signals (input image signal) which are input from the outside (for example, a personal computer (PC) and the like) are temporarily accumulated in a memory. Toner images of the corresponding colors are respectively formed based on digital image signals of four colors (Y (yellow) color, M (magenta) color, C (cyan) color, and K (black) color) which are accumulated in the memory. That is, the image forming units 10 (specifically, 10Y, 10M, 10C, and 10K) are respectively driven in accordance with the digital image signals of the corresponding colors. Then, in each of the image forming units 10, the photosensitive drum 11 charged by the charging roll 12 is irradiated with the laser beam Bm by the exposure unit 13, in accordance with the digital image signal, and thus, an electrostatic latent image is formed. The developing device 14 develops the electrostatic latent image formed on the photosensitive drum 11 so as to forma toner image of the corresponding color. In a case where the image forming apparatus 1 is configured as a copier, a scanner may read an original document set on a document table (not illustrated) and the obtained read signal may be converted into a digital image signal by the processing circuit. Then, similar to the above descriptions, a toner image of each of the colors may be formed.

Then, toner images formed on the photosensitive drums 11 are sequentially primarily transferred onto a surface of the intermediate transfer belt 20 at a primary transfer position at which the photosensitive drum 11 and the intermediate transfer belt 20 contact with each other, by the primary transfer roll 15. The toner remaining on the photosensitive drum 11 after the primary transfer is removed by the drum cleaner 16.

The toner images which have been primarily transferred to the intermediate transfer belt 20 in this manner are superimposed on the intermediate transfer belt 20. An image obtained by superimposition is transported to the secondary transfer position by rotating the intermediate transfer belt 20. The paper P is transported to the secondary transfer position at a predetermined timing and the paper P is nipped between the backup roll 24 and the secondary transfer roll 31.

The toner image held on the intermediate transfer belt 20 is secondarily transferred to the paper P at the secondary transfer position by an action of a transfer electric field formed between the secondary transfer roll 31 and the backup roll 24. The paper P to which the toner image is transferred is transported to the fixing device 50 by the transport belt 43. In the fixing device 50, the toner image on the paper P is fixed by heating and pressing. Then, the paper P on which the toner image is fixed is sent to an exit tray (not illustrated) provided on the outside of the apparatus. The toner remaining on the intermediate transfer belt 20 after the secondary transfer is removed by the belt cleaner 26.

Descriptions for Adjustment of Toner Density

In this manner, each of the image forming units 10Y, 10M, 10C, and 10K forms a toner image of the corresponding color component by using the electrophotographic process and primarily transfers the formed toner image of the corresponding color component to the intermediate transfer belt 20. Since the tandem image forming apparatus 1 uses the photosensitive drums 11, the charging roll 12, and the primary transfer roll 15 which are separate from each other for each of the image forming units 10Y, 10M, 10C, and 10K, a degree of deterioration of the components for the corresponding color is different. That is, the thickness of the photoreceptive layer provided on the photosensitive drum 11, the resistance value of the charging roll 12 or the primary transfer roll 15, and the like is different for each of the image forming units 10. Charging characteristics of the toner of each of the colors and the like are also different. The degree of deterioration is different depending on an installation environment and a use frequency of the image forming apparatus 1, image density of an image formed by the image forming apparatus 1, and the like. Thus, even when each of the image forming units 10Y, 10M, 10C, and 10K forms a toner image of the corresponding color component and primarily transfers the formed toner image onto the intermediate transfer belt 20 in order to form images having the same density for each of the colors, density of each of the color component toners in an image formed on the intermediate transfer belt 20 easily becomes different in practice. That is, a shift from the original toner density occurs due to a change with time. Thus, if the shift of the toner density occurs largely, image quality is easily degraded.

Accordingly, in this exemplary embodiment, each of the image forming units 10Y, 10M, 10C, and 10K creates a reference patch for density adjustment (image for density adjustment, toner image for density adjustment), and adjusts the toner density for each of the color components by using the created reference patch. That is, firstly, the reference patch for density adjustment is transferred onto the intermediate transfer belt 20. Then, the density detection sensor 27 reads toner density of the reference patch of each of the colors, which has been transferred onto the intermediate transfer belt 20. The control unit 60 calculates the toner density of each of the color components based on a result obtained through reading.

Figure 2:
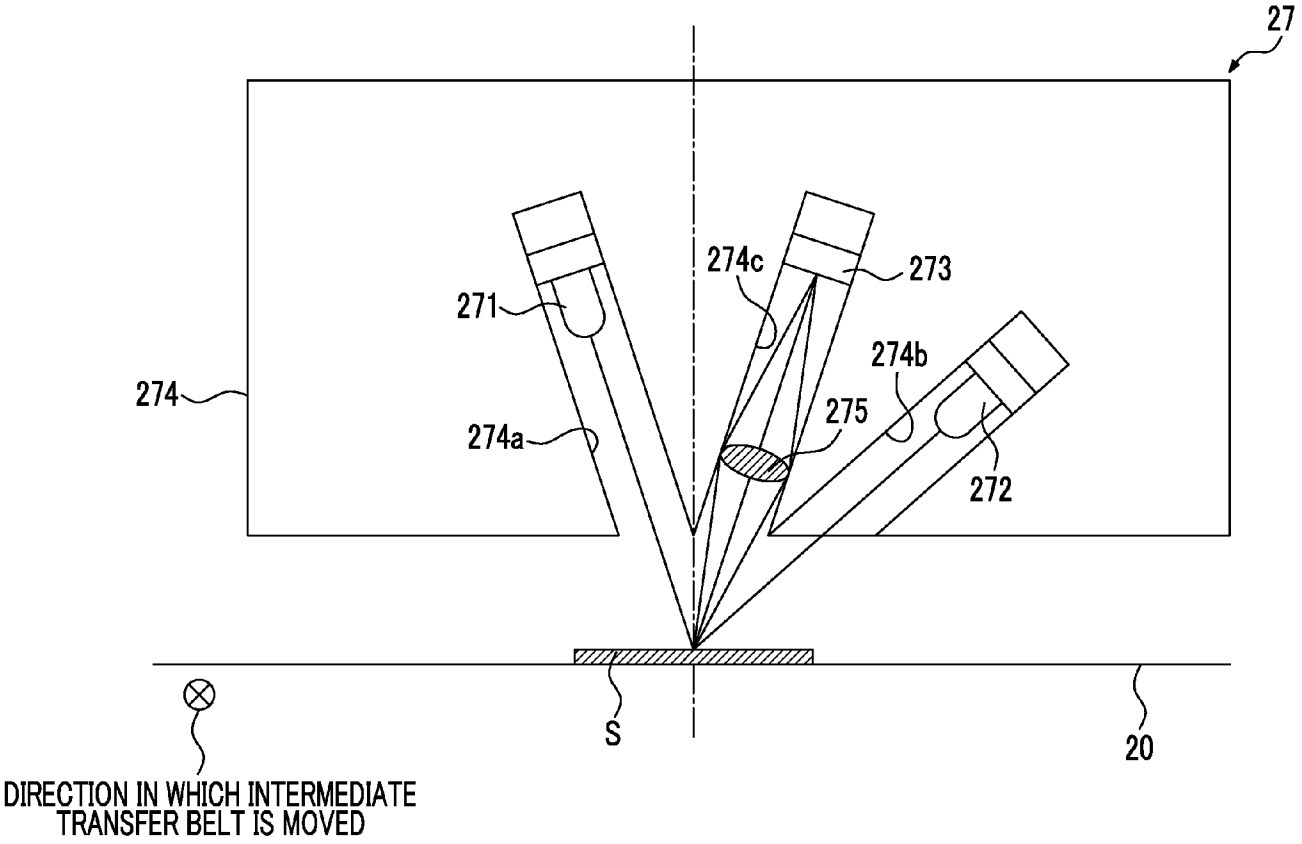
FIG. 2 is a cross-sectional view of a density detection sensor.

FIG. 2 is a cross-sectional view of the density detection sensor 27. FIG. 2 illustrates a cross-section obtained by cutting the density detection sensor 27 in a direction perpendicular to a direction of moving the intermediate transfer belt 20. The density detection sensor 27 includes a first light emitting device (LED) 271 and a second LED 272 which are used for irradiating the toner image holding surface of the intermediate transfer belt 20. The density detection sensor 27 includes a photo diode (PD) 273. The photo diode (PD) 273 receives reflected light from the intermediate transfer belt 20 and a reference patch S for density adjustment (which is formed on the intermediate transfer belt 20) which are irradiated by the first LED 271 and the second LED 272, and outputs a current value having intensity in accordance with the quantity of received light.

The first LED 271, the second LED 272, and the PD 273 are accommodated in a case 274 which has a downward opening. Light for irradiation emitted by the first LED 271 passes through a first emission slit 274*a* which is provided in the case 274 and the surface of the intermediate transfer belt 20 is irradiated with the light at an angle of 70°, for example. A second emission slit 274*b* is also provided in the case 274, and the second emission slit 274*b* guides light for irradiation from the second LED 272 to the surface of the intermediate transfer belt 20. Here, the intermediate transfer belt 20 is irradiated with the light for irradiation emitted by the second LED 272 at an angle of 135°, for example. Further, an incidence slit 274*c* is also provided in the case 274. The incidence slit 274*c* is used for causing the reflected light from the intermediate transfer belt 20 and the reference patch S formed on the surface of the intermediate transfer belt 20 to pass in the incidence slit 274*c* toward the PD 273. Here, the incidence slit 274*c* is provided so as to have a direction of, for example, 110° to the surface of the intermediate transfer belt 20. Thus, reflected light which is regularly reflected by the intermediate transfer belt 20 and the reference patch S in the light for irradiation emitted by the first LED 271 is incident on the PD 273. Reflected light which is diffused by the intermediate transfer belt 20 and the reference patch S in the light for irradiation emitted by the second LED 272 is incident on the PD 273. For example, because light is largely absorbed due to the toner in the black toner image, if only diffusion light is used, the quantity of received light may be insufficient. Thus, in the density detection sensor 27 according to this exemplary embodiment, the first LED 271 and the second LED 272 of which angles of attachment are different from each other are used as light sources. A lens 275 is mounted in the incidence slit 274*c*. The lens 275 is used for condensing incident light at a light receiving surface of the PD 273. The opening of the incidence slit 274*c* is set to ϕ 0.8, for example.

Figure 3:
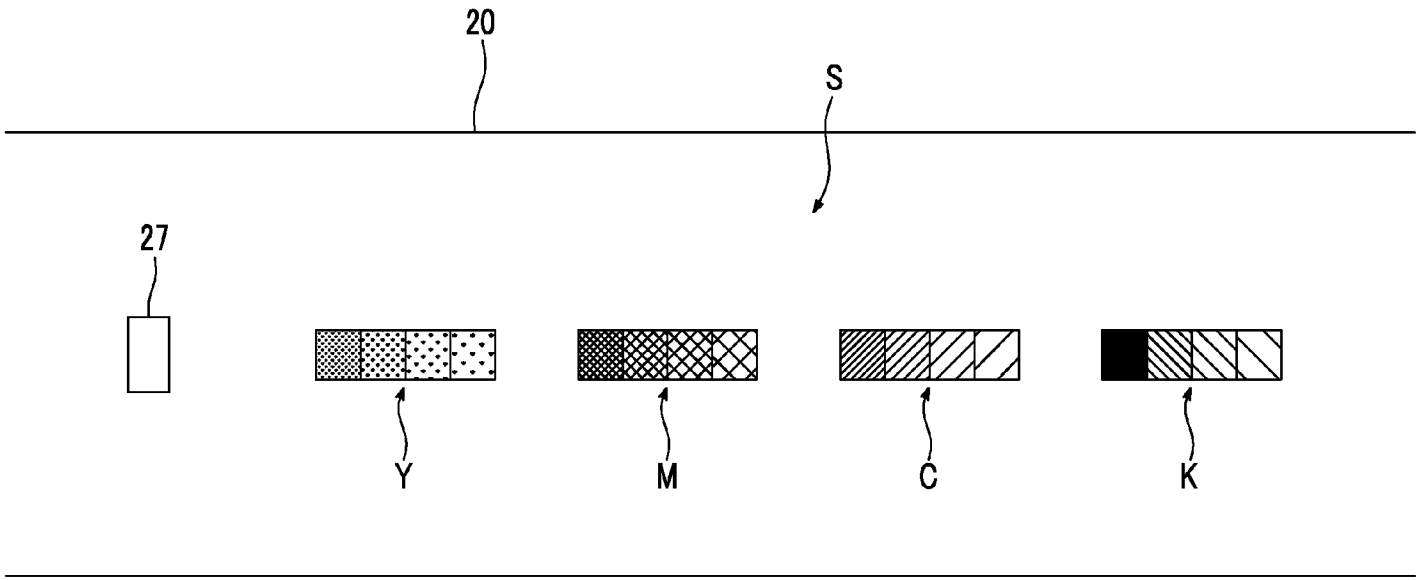
FIG. 3 is a diagram illustrating an example of a reference patch formed on an intermediate transfer belt.

FIG. 3 is a diagram illustrating an example of the reference patch S formed on the intermediate transfer belt 20.

The reference patch S illustrated in FIG. 3 corresponds to toner images which are created for each of the Y color, the M color, the C color, and the K color. Among the toner images, 4 images which are created for each of the Y color, the M color, the C color, and the K color so as to have setting density of 100%, 75%, 50%, 25%, for example, are used as the reference patch S. In the example illustrated in FIG. 3, the reference patch S is formed so as to be square. When each of the images in the reference patch S reaches the position of the density detection sensor 27, the density detection sensor 27 reads toner density of this image. When the reference patch S is read, the toner density is calculated based on a current value (output of the sensor) output from the density detection sensor 27.

In the image forming apparatus 1 according to this exemplary embodiment, a user may set a degree of adjusting the toner density (adjustment level). This is provided for a user as one of functions of the image forming apparatus 1, which are used for adjusting image quality. In practice, when setting of the degree of adjusting the toner density is performed, a user uses, for example, a user interface (UI) of the image forming apparatus 1. The UI is configured with a touch panel and the like.

Figure 4:
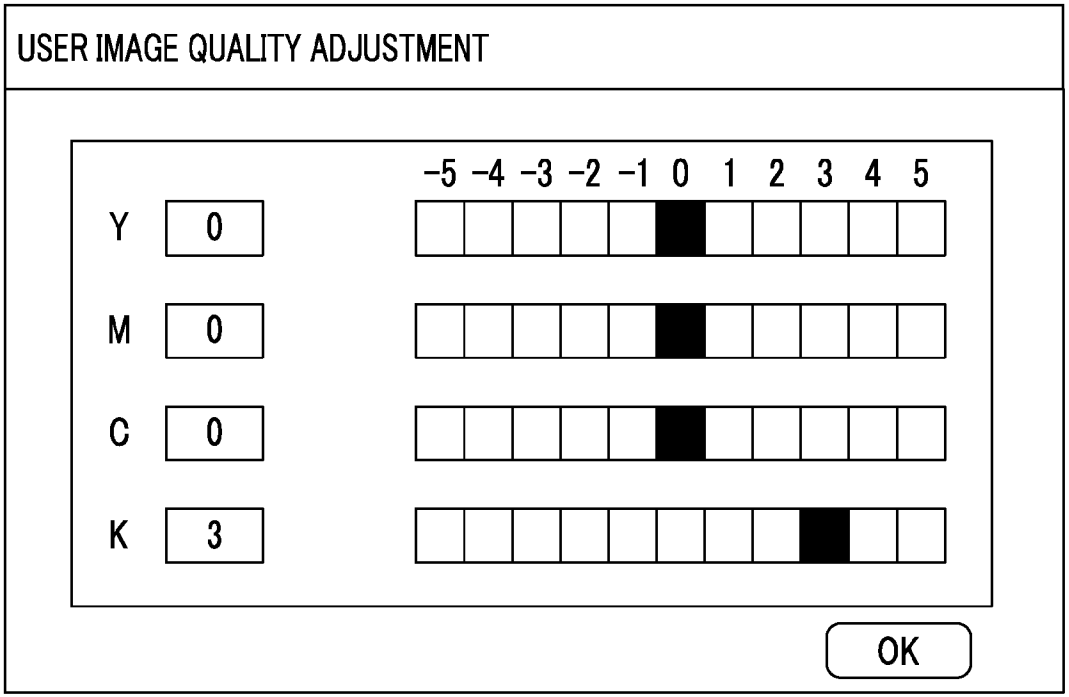
FIG. 4 is a diagram illustrating an example of a screen displayed on a UI when a user performs setting of adjustment of the toner density.

FIG. 4 is a diagram illustrating an example of a screen displayed on the UI when a user performs setting of adjustment of the toner density.

In the example illustrated in FIG. 4, a user may input a value of the toner density for each of the colors of the toner used in the image forming apparatus 1, in a range of −5 to 5. In this case, the toner density becomes light in a case where a value on a negative side of the range is input. Conversely, the toner density becomes thick in a case where a value on a positive side of the range is input. As an absolute value of the input value becomes greater, the toner density changes greater. A where the value is set to "0" means that a user does not perform setting of adjustment of the toner density. In a case where a touch panel is used as the UI, when a user wishes to input "3" for the K (black) color, for example, a place of the K color, which corresponds to "3" is touched on the touch panel. As a result, as illustrated in FIG. 4, the color of the touched place is displayed so as to be turned over and a numerical value of "3" is displayed. If the user inputs a numerical value for each of the colors and finally touches "OK", a user setting is determined.

In this exemplary embodiment, the user setting of the toner density is preferably performed for each predetermined toner density range. For example, if division into three density regions of "a low density portion", "a middle density portion", and "a high density portion" is performed, and the screen in FIG. 4 for each of the three density regions is displayed, a user performs inputting.

However, in a case where the user setting is added in the adjustment of the toner density, a result of adjustment intended by the user may not be obtained. For example, the toner density is adjusted depending on the tone characteristic of each of the colors before adjustment. However, in the related art, this point is not considered. Thus, such a result occurs. In addition, after adjusted to be an original toner density, the toner density may be adjusted so that the user setting is reflected thereto. However, in this case, the toner density is adjusted at two stages, and thus, the number of effective tones after the toner density is adjusted may be reduced. Accordingly, the toner density is desirably adjusted at one stage.

In this exemplary embodiment, the toner density is adjusted by using a method which will be described below.

A configuration of the control unit 60 which performs the above descriptions will be described below.

Description for Control Unit

Next, the control unit 60 will be described below. Here, firstly, the control unit 60 in a first exemplary embodiment will be described.

First Exemplary Embodiment

Figure 5:
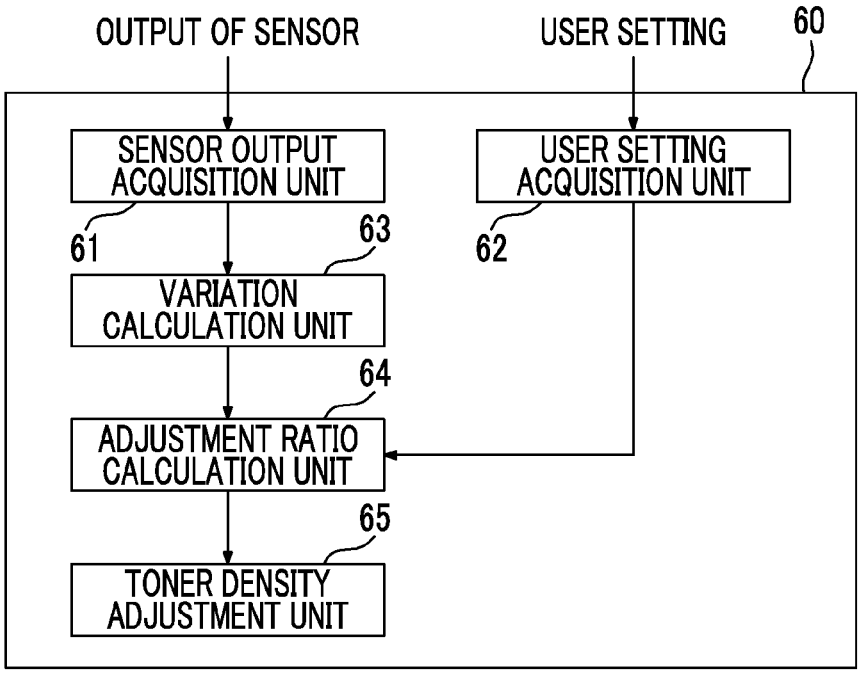
FIG. 5 is a block diagram illustrating a functional configuration example of a control unit in a first exemplary embodiment.

FIG. 5 is a block diagram illustrating a functional configuration example of the control unit 60 in the first exemplary embodiment. FIG. 5 illustrates functions which are selected as functions relating to this exemplary embodiment, from various functions of the control unit 60.

As illustrated in FIG. 5, the control unit 60 includes a sensor output acquisition unit 61 that acquires an output of the sensor, a user setting acquisition unit 62 that acquires a user setting for adjusting the toner density, a variation calculation unit 63 that obtains the variation in toner density, an adjustment ratio calculation unit 64 that calculates an adjustment ratio which is a ratio at which the user setting is reflected, and a toner density adjustment unit 65 that adjusts the toner density.

The sensor output acquisition unit 61 acquires the output of the sensor illustrated in FIG. 3.

The user setting acquisition unit 62 is an example of a user setting acquisition section that acquires a user setting, set by a user, concerning the degree of adjusting the toner density. Regarding the user setting, the user setting acquisition unit 62 acquires the user setting determined by an input of a user through the UI as illustrated in FIG. 4. At this time, the user setting acquisition unit 62 acquires the user setting for each predetermined toner density range ("low density portion, "middle density portion", and "high density portion").

The variation calculation unit 63 is an example of a variation calculation section that obtains the variation in toner density based on the detected toner density.

Firstly, the variation calculation unit 63 calculates an amount (ΔD) of deviation. The amount (ΔD) of deviation is a difference between density of the reference patch S obtained from an output value of the sensor and desired density. An amount (ΔLUT) of adjustment of an input image signal, which is used for the image forming unit 10 forming a toner image, is calculated from the obtained amount (ΔD) of deviation. The amount (ΔD) of deviation or the amount (ΔLUT) of adjustment of the input image signal corresponds to the variation in toner density.

Figure 6:
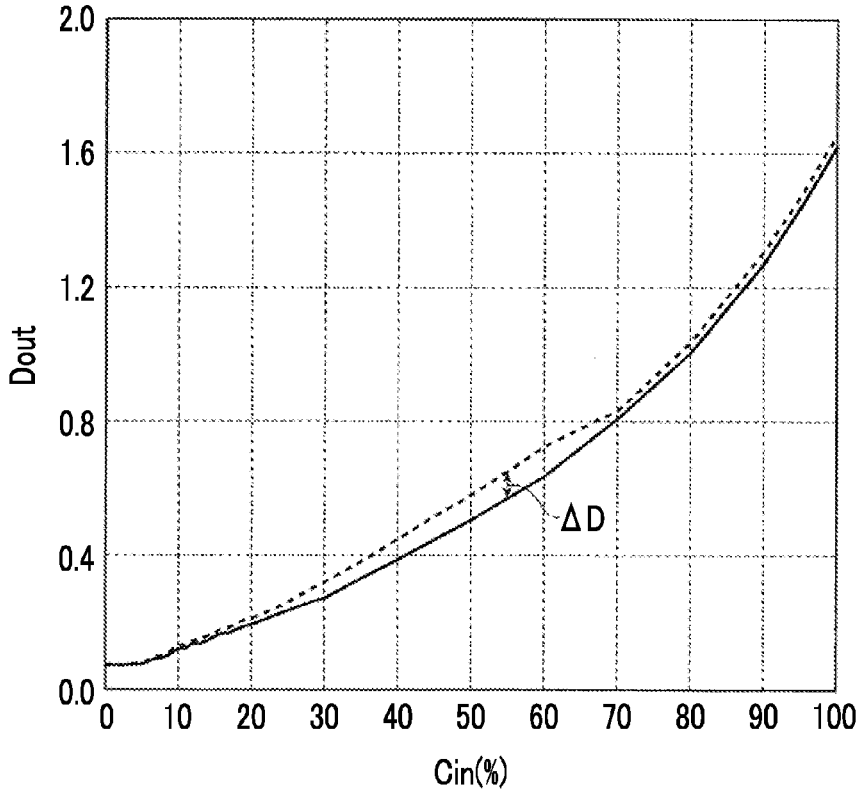
FIG. 6 is a diagram illustrating an example of an amount (ΔD) of deviation from an input image signal.

FIG. 6 is a diagram illustrating an example of the amount (ΔD) of deviation with respect to an input image signal.

In FIG. 6, a transverse axis indicates an input image signal (Cin) which is standardized so as to be from 0% to 100%. A vertical axis indicates toner density (Dout). A solid line indicates a relationship between an input image signal and a desired toner density. The relationship may be considered as a desired tone characteristic. A dotted line indicates a relationship between an input image signal and toner density which is a result obtained by measuring the reference patch S. The relationship may be considered as a tone characteristic before the toner density is adjusted. A difference between the solid line and the dotted line in a vertical direction in FIG. 6 functions as the amount (ΔD) of deviation.

The adjustment ratio calculation unit 64 is an example of an adjustment ratio calculation section that calculates an adjustment ratio (a) which is a ratio at which a user setting is reflected, in accordance with the amount (ΔLUT) of adjustment of the input image signal.

In this exemplary embodiment, when the toner density is adjusted, a user setting is not applied as it is, but is changed in accordance with the amount (ΔLUT) of adjustment of the input image signal. Here, the adjustment ratio (a) is obtained by using the amount (ΔLUT) of adjustment of the input image signal, but may be obtained by using the amount (ΔD) of deviation.

Figure 7A:
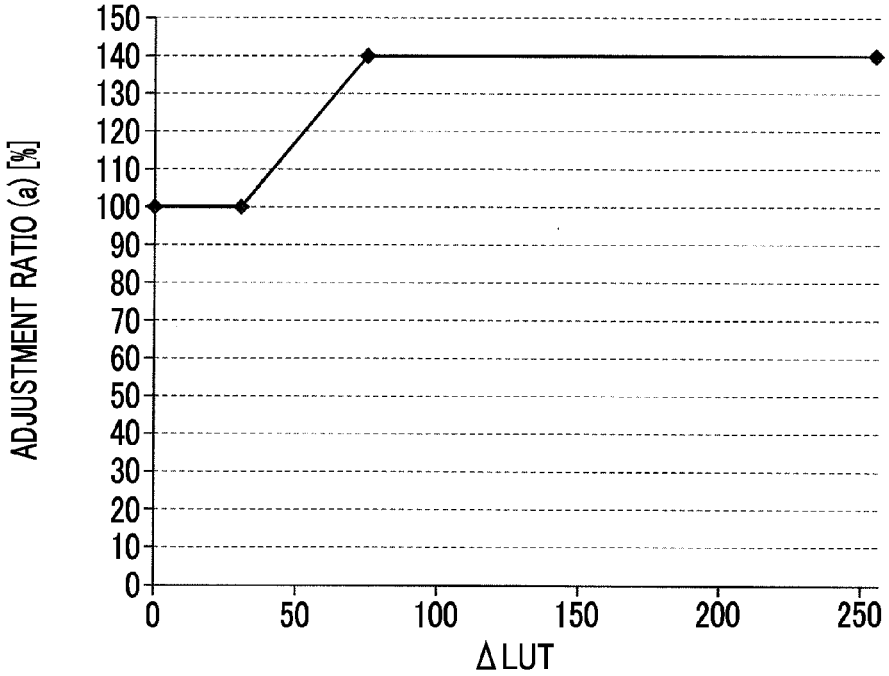
FIGS. 7A and 7B are diagrams illustrating a relationship between an amount (ΔLUT and −ΔLUT) of adjustment of the input image signal and an adjustment ratio (a)
Figure 7B:
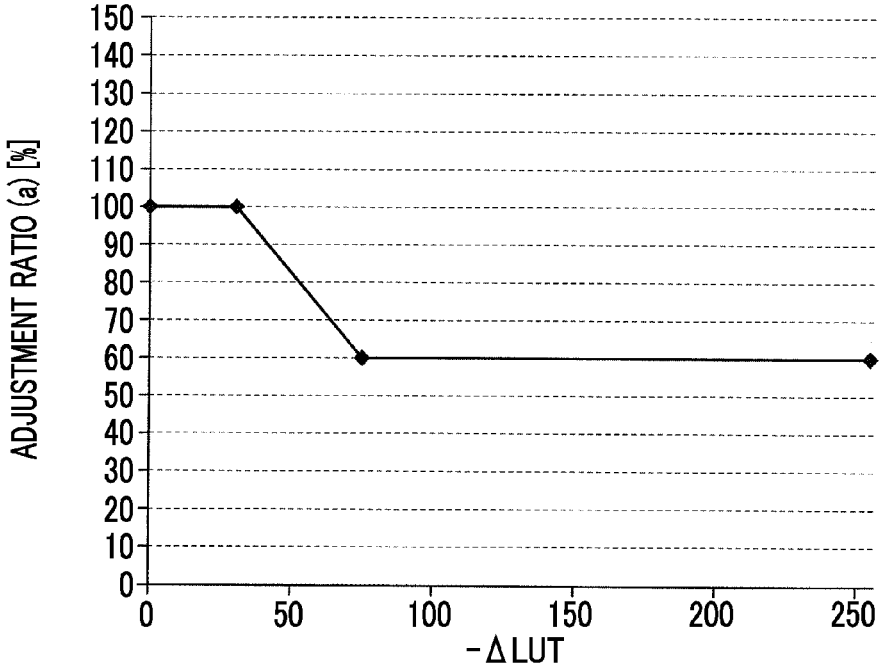

FIGS. 7A and 7B are diagrams illustrating a relationship between the amount (ΔLUT, −ΔLUT) of adjustment of an input image signal and the adjustment ratio (a).

In FIGS. 7A and 7B, a transverse axis indicates the amount (ΔLUT, −ΔLUT) of adjustment of the input image signal, and a vertical axis indicates the adjustment ratio (a).

As illustrated in FIG. 7A, a case where the amount (ΔLUT) of adjustment of the input image signal is positive means a tone characteristic in which Dout against Cin is too small. Thus, the adjustment ratio (a) increases with an increase of the amount (ΔLUT) of adjustment of the input image signal. It is not necessary that the adjustment ratio (a) is consecutively increased. As illustrated in FIG. 7A, a section in which the adjustment ratio (a) is not changed even when the amount (ΔLUT) of adjustment of an input image signal is changed may be present.

As illustrated in FIG. 7B, a case where the amount (ΔLUT) of adjustment of the input image signal is negative means a tone characteristic in which Dout against Cin is too large. Thus, the adjustment ratio (a) decreases with an increase of an absolute value of the amount (ΔLUT) of adjustment of the input image signal. In this case, it is not necessary that the adjustment ratio (a) is consecutively decreased. As illustrated in FIG. 7B, a section in which the adjustment ratio (a) is not changed even when the amount (ΔLUT) of adjustment of an input image signal is changed may be present.

FIG. 8 is a diagram illustrating an example in which a user setting is applied in the first exemplary embodiment.

In the example illustrated in FIG. 8, an input image signal (Cin) is standardized so as to be from 0% to 100%. The user setting is acquired in the above-described three toner density ranges of "the low density portion", "the middle density portion", and "the high density portion".

In the low density portion, 25×a %, 75×a %, 50×a %, and 25×a % are respectively set as ratios at which the user setting is reflected in cases where input image signals (Cin) respectively have 5%, 15%, 30%, and 50%. For example, when a numerical value input through the screen in FIG. 4 by a user is "1", the user setting has a value of 10. Thus, 10×(25×a) %, 10×(75×a) %, 10×(50×a) %, and 10×(25×a) % are respectively used as the amount of adjustment of the toner density in the low density portion, in the cases where input image signals (Cin) respectively have 5%, 15%, 30%, and 50%. Here, the user setting is set to have a value of "10", but the user setting is changed by the user inputting a numerical value in the range of −5 to 5 on the screen in FIG. 4. The user setting has a larger value as the numerical value input by the user is larger. As the numerical value input by the user is smaller, the user setting has a smaller value. For example, when a numerical value input on the screen in FIG. 4 by the user is "2", the user setting has a value of 30. When a numerical value input by the user is "−1", the user setting has a value of −10.

In the middle density portion, 10×a %, 25×a %, 50×a %, 25×a %, and 10×a % are respectively set in cases where input image signals (Cin) respectively have 15%, 30%, 50%, 75%, and 95%. In the high density portion, 10×a %, 25×a %, and 10×a % are respectively set in cases where input image signals (Cin) respectively have 75%, 95%, and 100%. These values of 10×a %, 25×a %, and the like may be referred to as "responsiveness" below.

The toner density adjustment unit 65 is an example of an adjustment section that adjusts the toner density based on the amount (ΔLUT) of adjustment of the input image signal, the user setting, and the adjustment ratio (a).

Specifically, for example, when a numerical value input through the screen in FIG. 4 by a user is "1", and when the input image signal (Cin) has 5%, the amount of adjustment of the toner density is set to 10×(25×a) %. As in a case where the input image signal (Cin) has 15%, amounts of adjustment which respectively correspond to "the low density portion" and "the middle density portion" are summed at a place at which "the low density portion" and "the middle density portion" overlap each other. That is, when the input image signal (Cin) has 15%, the amount of adjustment of the toner density is set to 10×(75×a+10×a) %.

Figure 9:
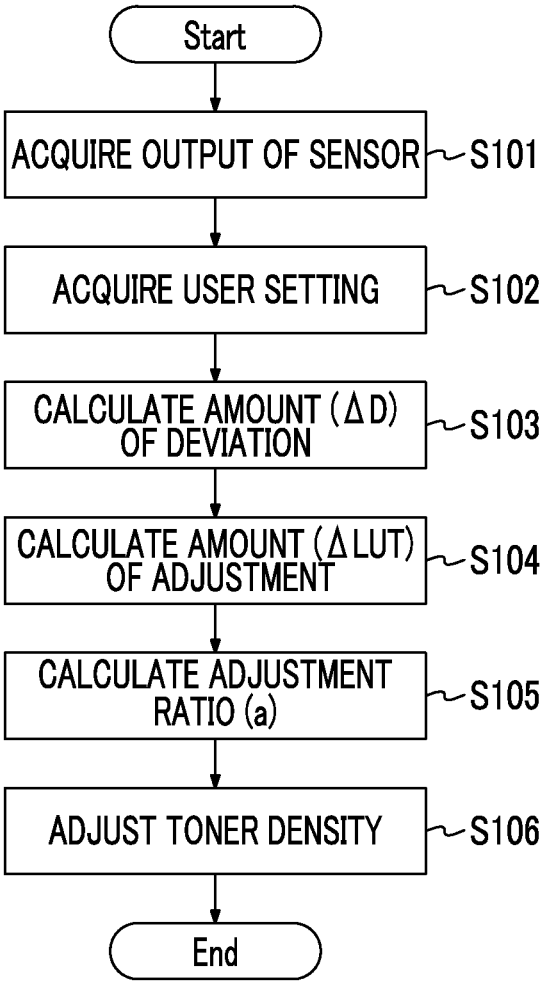
FIG. 9 is a flowchart illustrating an operation of the control unit in the first exemplary embodiment.

FIG. 9 is a flowchart illustrating the operation of the control unit 60 in the first exemplary embodiment.

The operation of the control unit 60 in the first exemplary embodiment will be described below with reference to FIGS. 5 and 9.

Firstly, when the toner density is adjusted, the sensor output acquisition unit 61 acquires an output of the sensor which is obtained by the density detection sensor 27 reading the reference patch S (Step 101). The toner density is regularly adjusted when the number of printed sheets after the previous adjustment of the toner density is equal to or greater than a predetermined value, or when a predetermined period of time elapses from when the previous adjustment of the toner density.

Then, the user setting acquisition unit 62 acquires a user setting relating to adjustment of the toner density (Step 102). The user setting may be acquired every time the toner density is adjusted, but user setting which has been previously input by a user may be used as it is.

The variation calculation unit 63 calculates the amount (ΔD) of deviation. The amount (ΔD) of deviation is a difference between density of the reference patch S obtained from an output value of the sensor and desired density (Step 103).

The variation calculation unit 63 calculates the amount (ΔLUT) of adjustment of the input image signal from the obtained amount (ΔD) of deviation (Step 104).

Next, the adjustment ratio calculation unit 64 calculates the adjustment ratio (a) in accordance with the amount (ΔLUT) of adjustment of the input image signal, by using the method as illustrated in FIGS. 7A and 7B (Step 105).

The toner density adjustment unit 65 adjusts the toner density based on the amount (ΔLUT) of adjustment of the input image signal, the user setting, and the adjustment ratio (a) (Step 106).

Second Exemplary Embodiment

Figure 10:
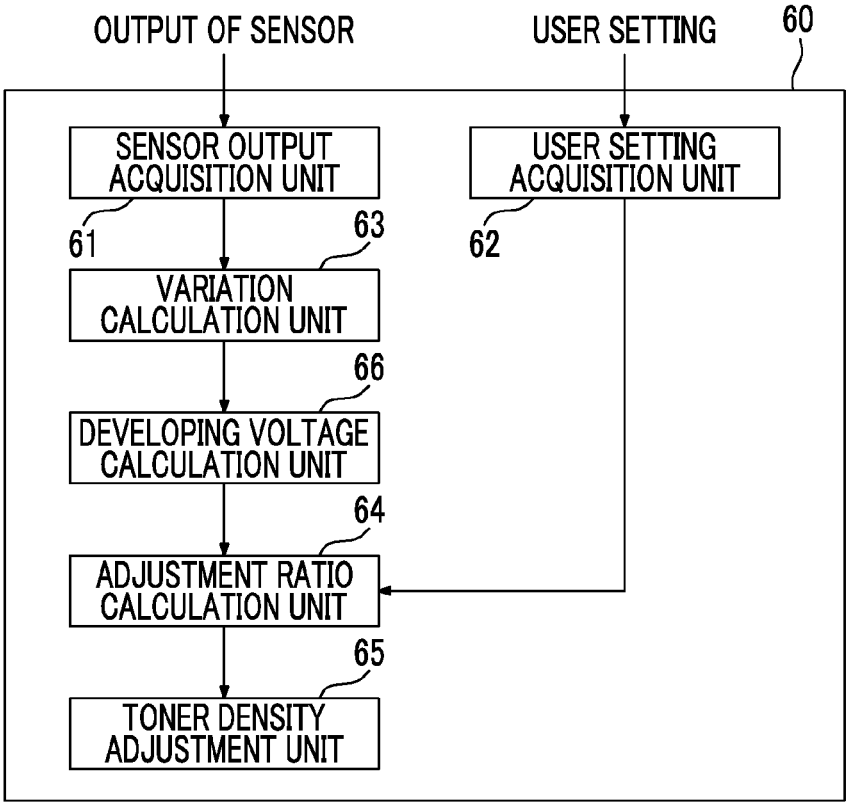
FIG. 10 is a block diagram illustrating a functional configuration example of a control unit in a second exemplary embodiment.

FIG. 10 is a block diagram illustrating a functional configuration example of a control unit 60 in a second exemplary embodiment. FIG. 10 also illustrates functions which are selected as functions relating to this exemplary embodiment, from various functions of the control unit 60.

The functional configuration example of the control unit 60 illustrated in FIG. 10 is similar to the control unit 60 in the first exemplary embodiment illustrated in FIG. 5 except that a developing voltage calculation unit 66 is further included.

Thus, descriptions focused on details of the developing voltage calculation unit 66 will be made below.

The developing voltage calculation unit 66 calculates a developing voltage after adjustment of the toner density, based on the amount (ΔLUT) of adjustment of the input image signal obtained by the variation calculation unit 63. The developing voltage calculation unit 66 adjusts the developing bias applied to the developing device 14 of the image forming unit 10, or adjusts the amount of exposure of the exposure unit 13.

Here, a predetermined lower limit value or a predetermined upper limit value may be provided for the developing voltage. In a case where the developing voltage is out of a range from the lower limit value to the upper limit value, that is, in a case where the developing voltage is lower than the lower limit value or greater than the upper limit value, defects easily occur in a formed image.

The case where the developing voltage calculated by the developing voltage calculation unit 66 is out of the range from the lower limit value to the upper limit value corresponds to a case where the toner density before adjustment is too thick or too light for each of the colors. This may also correspond to a case where the amount (ΔD) of deviation is too great.

Figure 11A:
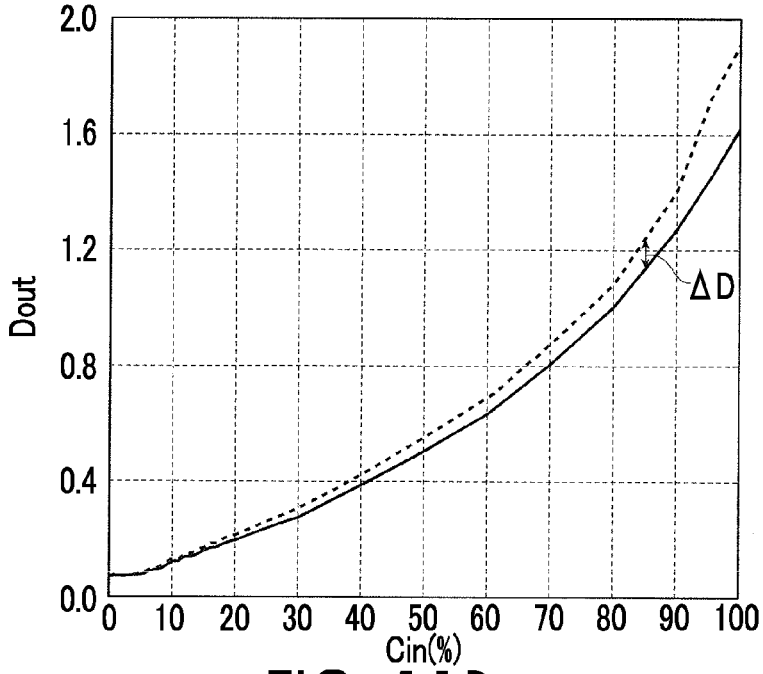
FIG. 11A is a diagram illustrating an example of a tone characteristic when a developing voltage calculated by a developing voltage calculation unit is lower than a lower limit value.

FIG. 11A is a diagram illustrating an example of the tone characteristic when the developing voltage calculated by the developing voltage calculation unit 66 is lower than the lower limit value.

In FIG. 11A, a transverse axis indicates an input image signal (Cin) which is standardized so as to be from 0% to 100%. A vertical axis indicates toner density (Dout). A solid line indicates a desired tone characteristic. A dotted line indicates the tone characteristic before adjustment of the toner density.

The tone characteristic before adjustment of the toner density, which is indicated by the dotted line, is largely shifted from the desired tone characteristic indicated by the solid line in a direction in which the toner density becomes thicker. That is, the toner density is too thick. In this case, the toner density is required to be largely adjusted in a direction in which the toner density becomes light. However, as a result, the developing voltage calculated by the developing voltage calculation unit 66 may be lower than the lower limit value.

Figure 11B:
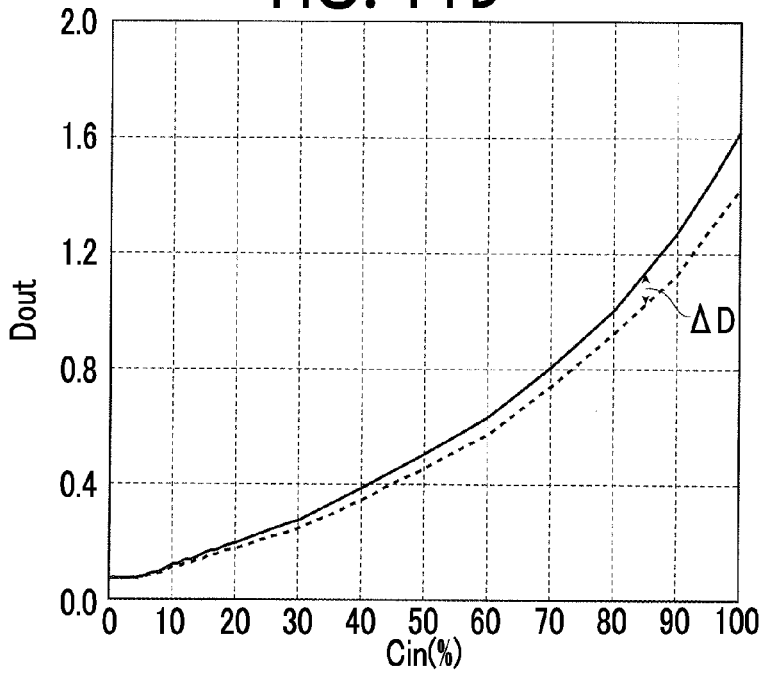
FIG. 11B is a diagram illustrating an example of the tone characteristic when the developing voltage calculated by the developing voltage calculation unit is greater than an upper limit value.

FIG. 11B is a diagram illustrating an example of the tone characteristic when the developing voltage calculated by the developing voltage calculation unit 66 is greater than the upper limit value.

In FIG. 11B, a transverse axis and a vertical axis are similar to those in FIG. 11A. Similarly, a solid line indicates a desired tone characteristic. A dotted line indicates the tone characteristic before adjustment of the toner density.

The tone characteristic before adjustment of the toner density, which is indicated by the dotted line is largely shifted from the desired tone characteristic indicated by the solid line in the direction in which the toner density becomes light. That is, the toner density is too light. In this case, the toner density is required to be largely adjusted in a direction in which the toner density becomes thick. However, as a result, the developing voltage calculated by the developing voltage calculation unit 66 may be greater than the upper limit value.

In this exemplary embodiment, in this manner, when the developing voltage is lower than the predetermined lower limit value or greater than the predetermined upper limit value, the adjustment ratio calculation unit 64 separately calculates an adjustment ratio for a toner density range (for example, high density portion) which is greater than a predetermined density. The toner density range which is greater than the predetermined density may be the above-described high density portion, for example.

FIG. 12 is a diagram illustrating an example in which a user setting is applied in the second exemplary embodiment.

If the illustration of FIG. 12 is compared to the illustration of FIG. 8, the values for the low density portion and the middle density portion are similar to each other. That is, the adjustment ratio is "a". In the high density portion, a "b" is separately calculated as the adjustment ratio. When the developing voltage is lower than the lower limit value or greater than the upper limit value, the amount (ΔLUT) of adjustment of the input image signal may be adjusted in accordance with the developing voltage. Thus, at this time, the amount (ΔD) of deviation is preferably used as the variation in toner density, instead of the amount (ΔLUT) of adjustment of the input image signal.

Figure 13A:
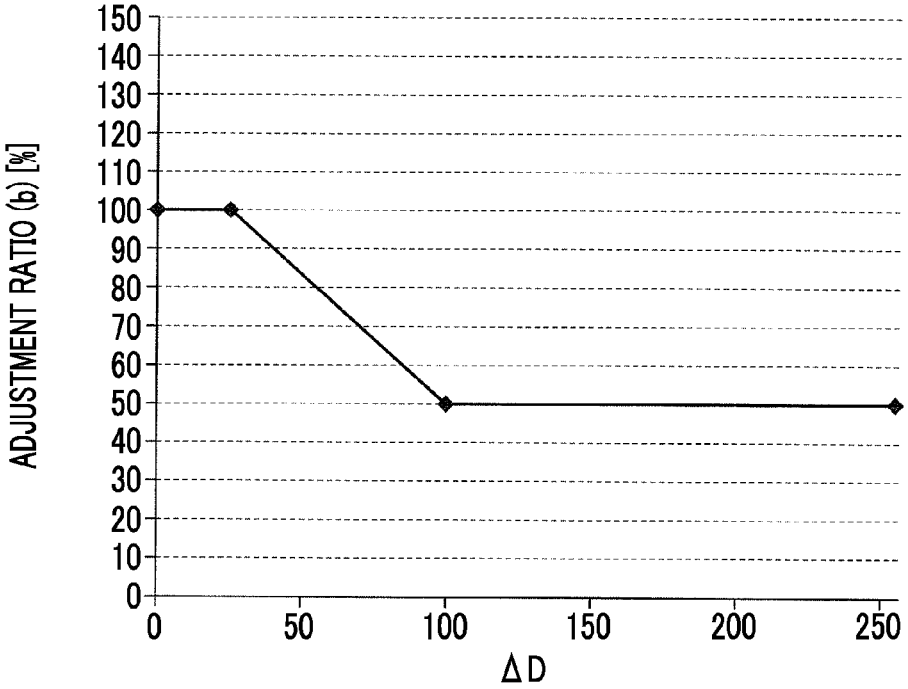
FIG. 13A is a diagram illustrating a relationship between the amount (ΔD) of deviation and an adjustment ratio (b) when the developing voltage calculated by the developing voltage calculation unit is lower than the lower limit value.

FIG. 13A is a diagram illustrating a relationship between the amount (ΔD) of deviation and the adjustment ratio (b) when the developing voltage calculated by the developing voltage calculation unit 66 is lower than the lower limit value. In this case, because the toner density tends to be too thick, the adjustment ratio (b) is decreased with an increase of the amount (ΔD) of deviation. It is not necessary that the adjustment ratio (b) is consecutively decreased. As illustrated in FIG. 13A, a section in which the adjustment ratio (b) is not changed even when the amount (ΔD) of deviation is changed may be present.

Figure 13B:
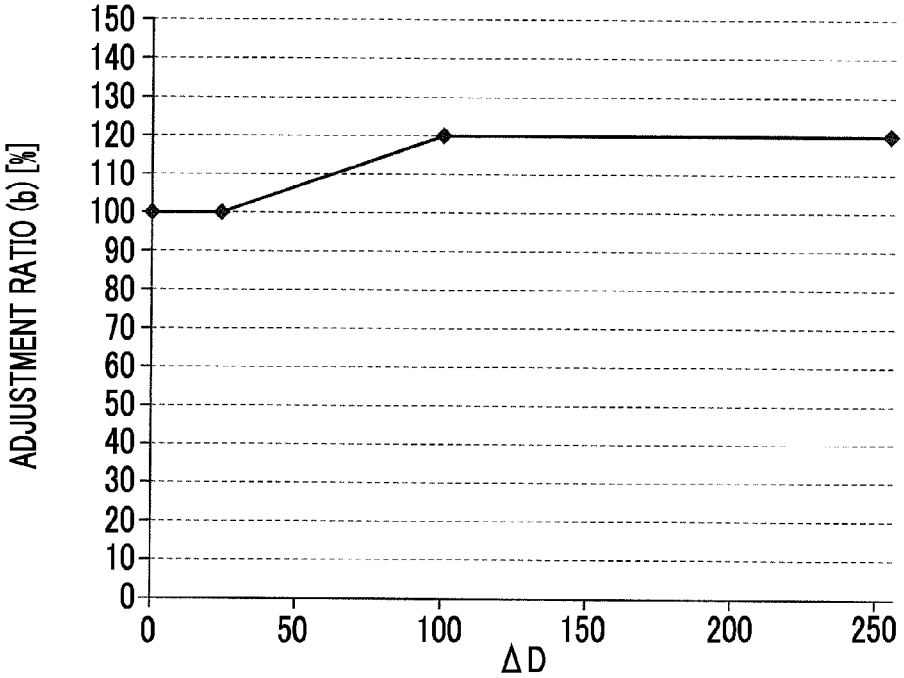
FIG. 13B is a diagram illustrating a relationship between the amount (ΔD) of deviation and the adjustment ratio (b) when the developing voltage calculated by the developing voltage calculation unit is greater than an upper limit value.

FIG. 13B is a diagram illustrating a relationship between the amount (ΔD) of deviation and the adjustment ratio (b) when the developing voltage calculated by the developing voltage calculation unit 66 is greater than the upper limit value. In this case, because the toner density tends to be too light, the adjustment ratio (b) is increased with an increase of the amount (ΔD) of deviation. In this case, it is not also necessary that the adjustment ratio (b) is consecutively increased. As illustrated in FIG. 13B, a section in which the adjustment ratio (b) is not changed even when the amount (ΔD) of deviation is changed may be also present.

In a case where the illustrations of FIGS. 13A and 13B are compared to each other, the adjustment ratio (b) in FIG. 13B is set to be lower than the adjustment ratio (b) in FIG. 13A. In a case of FIG. 13B, if the adjustment ratio (b) is set to be high, the density may be saturated and the number of effective tones after adjustment of the toner density may be reduced.

Figure 14:
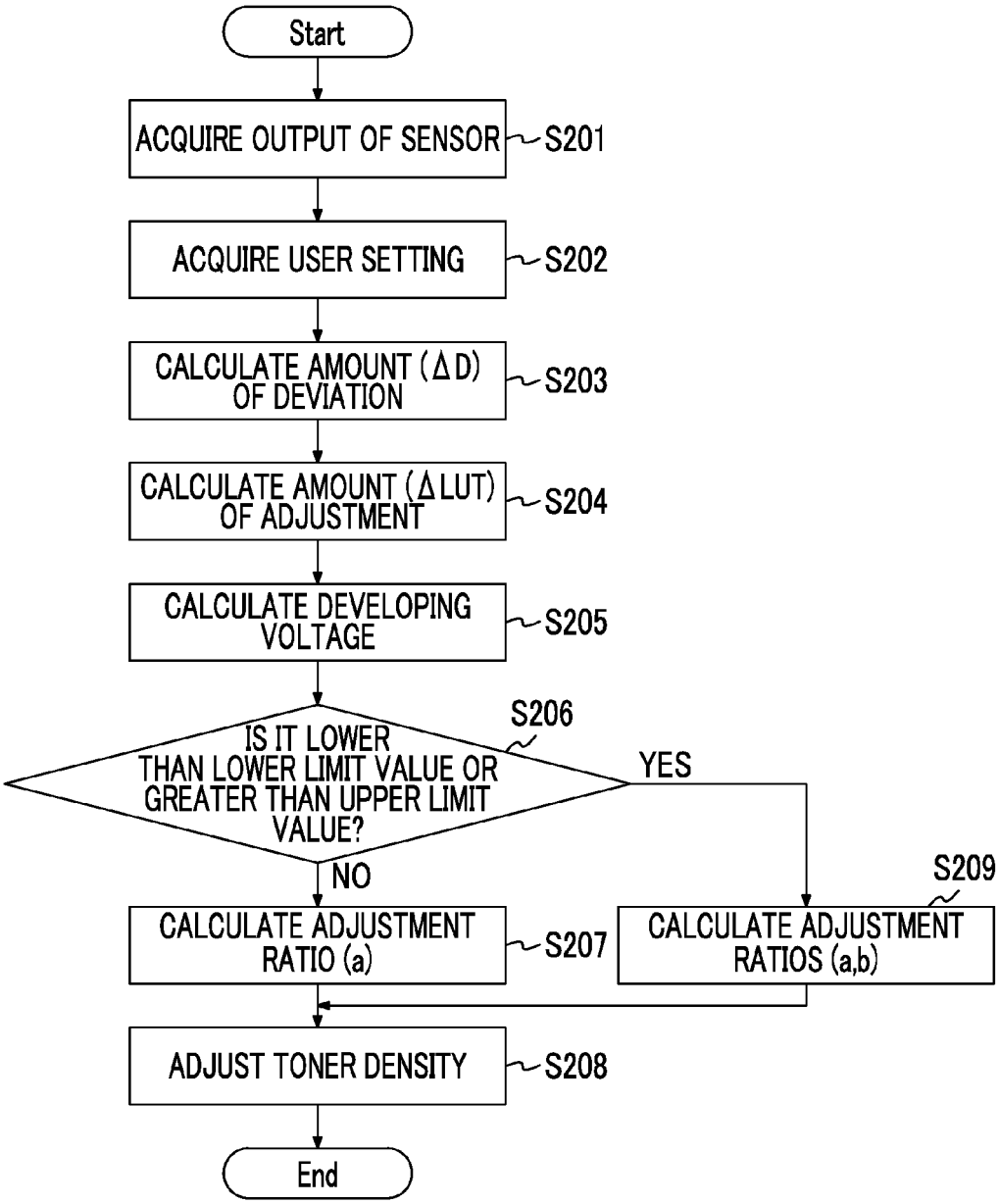
FIG. 14 is a flowchart illustrating an operation of the control unit in the second exemplary embodiment.

FIG. 14 is a flowchart illustrating an operation of the control unit 60 in the second exemplary embodiment.

The operation of the control unit 60 in the second exemplary embodiment will be described below with reference to FIGS. 10 and 14.

Since the processes of Step 201 to Step 204 are similar to the processes of Step 101 to Step 104 in FIG. 9, descriptions for these processes will be omitted.

In this exemplary embodiment, after the process of Step 204, the developing voltage calculation unit 66 calculates the developing voltage (Step 205).

Then, the developing voltage calculation unit 66 determines whether or not the calculated developing voltage is lower than the lower limit value or greater than the upper limit value (Step 206).

In a case where the calculated developing voltage is not lower than the lower limit value or greater than the upper limit value (No in Step 206), the subsequent processes of Step 207 to Step 208 are similar to the processes of Step 105 to Step 106 in FIG. 9.

In a case where the calculated developing voltage is lower than the lower limit value or greater than the upper limit value (Yes in Step 206), the adjustment ratio calculation unit 64 calculates the adjustment ratio (a) and the adjustment ratio (b) in accordance with the amount (ΔLUT) of adjustment of the input image signal or the amount (ΔD) of deviation, by using the method as illustrated in FIGS. 7 and 13 (Step 209).

Then, the process proceeds to Step 208.

In the above-described methods according to the first exemplary embodiment and the second exemplary embodiment, if the toner density is adjusted, a user setting is not applied as it is, but an amount by which the user setting is reflected is adjusted in accordance with the adjustment ratio (a). The adjustment ratio (a) is determined in accordance with the amount (ΔLUT) of adjustment of the input image signal. With this configuration, once adjustment of the toner density causes adjustment obtained by adding the user setting in a state of being adjusted to the desired toner density, and causes a result of adjustment of the toner density to easily be toner density desired by the user.

In the second exemplary embodiment, when the developing voltage is lower than the predetermined lower limit value or greater than the predetermined upper limit value, the adjustment ratio (b) is used separately to adjust a range in which the user setting is reflected. Thus, both of suppression of occurrence of defects in a formed image and obtaining of a result of adjusting the toner density, which is desired by the user are achieved.

An image forming method performed by the above-described image forming apparatus 1 may be recognized as an image forming method which includes detecting toner density of a toner image formed by the image forming unit 10, obtaining a variation in toner density based on the detected toner density, acquiring a user setting, set by a user, concerning a degree of adjusting the toner density, calculating the adjustment ratio (a or b) which is a ratio at which the user setting is reflected, in accordance with the amount (ΔLUT) of adjustment of an input image signal or the amount (ΔD) of deviation, and adjusting the toner density based on the amount (ΔLUT) of adjustment of the input image signal, the user setting, and the adjustment ratio (a or b).

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a toner image forming section that forms a toner image;

a detection section that detects a toner density of the formed toner image;

a variation calculation section that obtains a variation in toner density based on the detected toner density;

a user setting acquisition section that acquires a user setting concerning a degree of adjusting the toner density, the user setting being set by a user;

an adjustment ratio calculation section that calculates an adjustment ratio which is a ratio at which the user setting is reflected, in accordance with the variation in toner density; and an adjustment section that adjusts the toner density based on the variation in toner density, the user setting, and the adjustment ratio.

2. The image forming apparatus according to claim 1, wherein the user setting acquisition section acquires the user setting for each predetermined toner density range.

3. The image forming apparatus according to claim 2, wherein the adjustment section adjusts the toner density by changing a developing voltage when the toner image forming section forms the toner image, and when the developing voltage is lower than a predetermined lower limit value or greater than a predetermined upper limit value, the adjustment ratio calculation section separately calculates another adjustment ratio for a toner density range which is greater than a predetermined density.

4. The image forming apparatus according to claim 1, wherein the adjustment section adjusts the toner density by changing a developing voltage when the toner image forming section forms the toner image, and when the developing voltage is lower than a predetermined lower limit value or greater than a predetermined upper limit value, the adjustment ratio calculation section separately calculates another adjustment ratio for a toner density range which is greater than a predetermined density.

5. The image forming apparatus according to claim 1, wherein the user setting acquisition section acquires user settings for first to third toner density ranges, respectively, an upper limit of the first toner density range is less than a lower limit of the second toner density range, and an upper limit of the second toner density range is less than a lower limit of the third toner density range.

6. The image forming apparatus according to claim 5, wherein the adjustment section adjusts the toner density by changing a developing voltage when the toner image forming section forms the toner image, and when the developing voltage is lower than a predetermined lower limit value or greater than a predetermined upper limit value, the adjustment ratio calculation section calculates another adjustment ratio for the third toner density range.

7. An image forming method comprising:

detecting a toner density of a toner image formed by a toner image forming section;

obtaining a variation in toner density based on the detected toner density;

acquiring a user setting concerning a degree of adjusting the toner density, the user setting being set by a user;

calculating an adjustment ratio which is a ratio at which the user setting is adjusted, in accordance with the variation in toner density; and adjusting the toner density based on the variation in toner density, the user setting, and the adjustment ratio.

* * * * *